US006994571B2

(12) United States Patent
Hoffmann

(10) Patent No.: US 6,994,571 B2
(45) Date of Patent: Feb. 7, 2006

(54) CURRENT-RAIL ADAPTER

(75) Inventor: Dieter Hoffmann, Sundern (DE)

(73) Assignee: Erco Leuchten GmbH, Ludenscheid (DE)

( * ) Notice: Subject to any disclaimer, the term of this patent is extended or adjusted under 35 U.S.C. 154(b) by 0 days.

(21) Appl. No.: 10/802,698

(22) Filed: Mar. 17, 2004

(65) Prior Publication Data

US 2004/0248441 A1 Dec. 9, 2004

(30) Foreign Application Priority Data

Mar. 18, 2003 (DE) ..... 103 12 201

(51) Int. Cl.
*H01R 25/00* (2006.01)

(52) U.S. Cl. ..... 439/110

(58) Field of Classification Search ..... 439/110, 439/111, 121, 122, 532
See application file for complete search history.

(56) References Cited

U.S. PATENT DOCUMENTS 3,832,503 A * 8/1974 Crane ..... 439/110
4,032,208 A * 6/1977 Berkenhoff ..... 439/122
6,056,561 A * 5/2000 Lin ..... 439/121
6,059,582 A * 5/2000 Tsai ..... 439/121

FOREIGN PATENT DOCUMENTS

| | | |
|---|---|---|
| DE | 28 10 681 | 9/1979 |
| GB | 70 20 664 | 6/1970 |
| WO | WO 94/24731 | * 10/1994 |

* cited by examiner

*Primary Examiner*—Tho D. Ta
(74) *Attorney, Agent, or Firm*—Herbert Dubno; Andrew Wilford

(57) ABSTRACT

An insert part can fit into the slot of a power track. A shaft extending into the insert part is pivotal about a shaft axis in the housing between a use position and a nonuse position. A one-piece conductive contact element rotationally fixed to the shaft has a contact projecting radially from the shaft and engageable with one of the power-track conductors when the insert part is fitted to the slot and the shaft is in the use position, and a one-piece plug-type terminal extending generally parallel to the axis. Formations unitarily formed with the contact element and the shaft axially and rotationally fix the contact element on the shaft. A hookup wire provided with another plug-type terminal mates with the terminal of the contact element.

9 Claims, 8 Drawing Sheets

CURRENT-RAIL ADAPTER

FIELD OF THE INVENTION

The invention relates to a device or adapter for at least indirect connection of a lamp with a power track wherein at least one control shaft is angularly movable in a housing about a pivot axis and is rotationally coupled to at least one contact, in particular a neutral contact or a hot contact, for contacting conductors in the power track, the contacts being connectable with the lamp via respective wires.

BACKGROUND OF THE INVENTION

A device for at least indirectly connecting a lamp with a power track is generally called a power-track adapter. It serves normally for the mechanical and electrical connection of a lamp with a power track. On the one hand the lamp or a lamp holder is connected by a mechanical retaining element with the power-track adapter. On the other hand the electrical feed wires of the lamp are connected with contacts of the power-track adapter.

The power-track adapter normally has an insert part that fits into a slot of the power track. A normally provided first control shaft effects to start with the mechanical mounting of the power-track adapter with the power track, to which end retaining tabs are extended out from a nonuse position inside the housing so as to project from the housing and fit into retaining grooves in the power track. At the same time normally a ground contact tab is pivoted out and serves for engagement with a ground line. Once the first control shaft is in its use position, a latching/coupling mechanism pivots a second control shaft so that hot-line contacts are moved into engagement with the live conductors in the power track.

The neutral contact and hot contact are fixed on the respective control shafts so that when the control shafts are pivoted about their axes the contacts are also pivoted.

German 2,810,681 of the instant applicant describes a power-track adapter that has been produced in the same format and in large numbers for decades.

OBJECT OF THE INVENTION

Even though this device has been used for long times, there is some need to simplify its assembly.

SUMMARY OF THE INVENTION

The invention achieves this object in that the contact is provided with a connector, in particular a plug-type terminal tab that extends generally parallel to the pivot axis and an end of the wire has another terminal, in particular a flat female terminal, for connection with the terminal tab.

The principle of the invention is basically that instead of the prior-art screw-type terminal clips for fastening to the connector wires of the lamp, plug-type terminal tabs are provided. With the device of the prior art each terminal consists of a base part that is unitary with the contact, an abutment plate with a threaded hole, and a screw fitted to the hole. Thus each contact includes at least three parts.

Whereas the prior-art systems require space and access for the terminal screws, making assembly very difficult because of the tight quarters, with the device according to the invention it is possible to electrically connect the hookup wires by plugging them into the terminal tabs. The provision of a plug-type connection instead of a screw connection greatly simplifies assembly. In addition it makes it possible to substantially reduce the number of parts. The terminal tab, which advantageously is unitary with the contact, preferably extends generally parallel to the pivot axis so that it is possible to get a flat female terminal inside the housing. In particular there is with this arrangement very little bending stress for the end of the wire when the control shaft is pivoted, as the orientation of the terminal tab only produces a slight radius of pivoting of the flat female terminal. In this manner the end of the wire is bent only slightly which leads to minimal stress and a very long service life.

Of course it is within the scope of the invention to reverse the plug connection so that a flat female terminal sleeve is provided on the contact extending in a direction parallel to the pivot axis and fixed on the control shaft and the end of the feed wire is provided with a male terminal tab. Similarly other plug-type connections are usable instead of a terminal tab and a flat terminal sleeve to produce a similar plug-type electrical connection.

It is furthermore possible with the solution according to the invention to at least partially automate the assembly of the power-track adapter. Hooking up the feed wires can be done by a machine, further simplifying assembly.

According to a preferred embodiment of the invention the contact is unitarily formed with the terminal tab. This makes it possible further to simplify assembly and reduce parts. This also reduces production costs. This embodiment is particularly advantageous from an electrical point of view as in produces no voltage drop.

According to a further advantageous embodiment of the invention the contact is unitary with a spring leg. In this embodiment of the invention the spring leg serves to prestress the contact radially outward when the contact is shifted from its nonuse position by pivoting of the control shaft into its use position and contacts the conductor strip in the power track. The construction of the invention thus produces a more simplified and also cheaper construction while making assembly even simpler than with the prior art system having a separate biasing spring.

According to a further preferred embodiment of the invention the control shaft is hollow. Such a hollow control shaft is for example possible in that it produces an axially throughgoing passage through which further feed wires can be passed. A hollow control shaft according to the invention also is provided when there is a compartment in one axial region of the control shaft. This makes it possible to mount the contacts particularly easily in the control shaft, thus either in the central throughgoing bore or in the compartment.

According to a further preferred embodiment of the invention the control shaft has a throughgoing passage for at least one further wire. In this embodiment of the invention the power-track adapter is particularly compact since the passage, which preferably is near the pivot axis of the control shaft, is usable to guide feed wires into the interior of the housing without them interfering with pivoting of the control shaft.

According to a further preferred embodiment of the invention the terminal tab is immediately adjacent the pivot axis.

This produces a particularly compact construction and also minimizes bending stresses of the hookup wires.

According to a further preferred embodiment of the invention the terminal tab is on the pivot axis. With this preferred embodiment of the invention, bending stresses of the hookup wire are minimized.

According to a further preferred embodiment of the invention the female terminal sleeve is displaceable along the pivot axis for connection with the terminal tab. In this embodiment there is the particular advantage that the control shaft can be mounted so that it does not move axially, and is in fact held between axial stops, so that when contact is made the flat female terminal must only be secured on the housing and the stationary housing forms a mount for the flat female terminal. This further facilitates an automatic machine assembly.

BRIEF DESCRIPTION OF THE DRAWING

Further advantages are seen below with reference to the following description of an embodiment shown in the figures. In the drawing.

SPECIFIC DESCRIPTION

Figure 1:
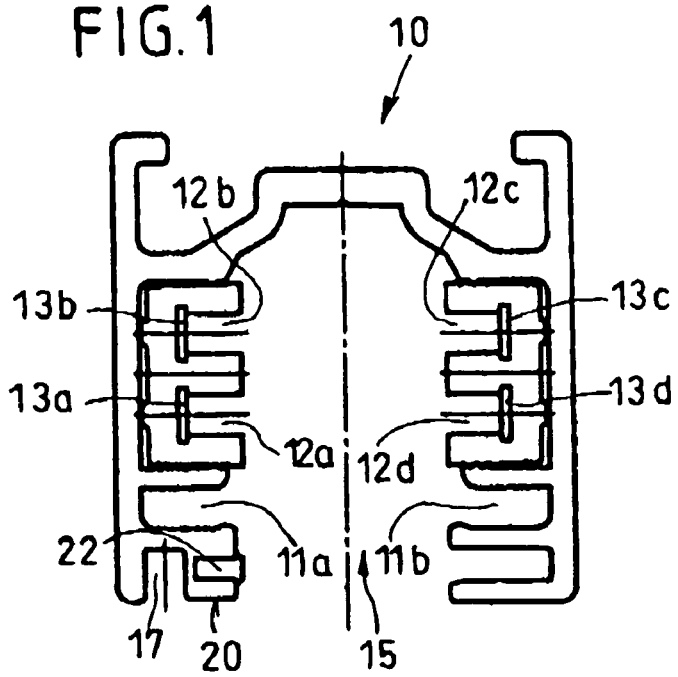
FIG. 1 is an end view of a power track.

The device shown generally in the figures at 14 is intended to be installed in the power track shown in FIG. 1 at 10.

Both the power-track adapter 14 as well as the power track 10 correspond generally functionally to applicant's power-track adapter shown in German 2,810,681, so there will be no repetition. Nonetheless it is noted that the power track 10 is secured in a structure, for example on a ceiling, and has a slot 15 for a narrow insert part 16 (FIG. 3) of the adapter 14.

The power track 10 has a locator groove 17 in which engage locator elements 18*a* and 18*b* formed as tabs and carried on the device 14. When installed, the adapter 14 fits with its entire head or insert part 16 shown in FIG. 3 in the slot 15 so that an adapter face 19 bears on or is closely juxtaposed with a lower face 20 of the power track 10.

Inside the power track 10 are several grooves. Closest to the mouth of the slot 15 are retaining grooves 11*a* and 11*b* that receive retaining tongues 21*a* and 21*b* (FIG. 8) as described below. In addition in this embodiment the power track 10 has four contact grooves 12*a*, 12*b*, 12*c*, and 12*d* in whose bases are respective conductors 13*a*, 13*b*, 13*c*, and 13*d*. Normally the conductor 13*d* is neutral and the remaining three conductors 13*a*, 13*b*, and 13*c*, here referenced R, S, and T, are hot.

The power track 10 is preferably an extruded profile of light metal, in particular aluminum, while the conductors 13*a*, 13*b*, 13*c*, and 13*d* are copper strips. There is also a ground conductor 22.

Figure 2:
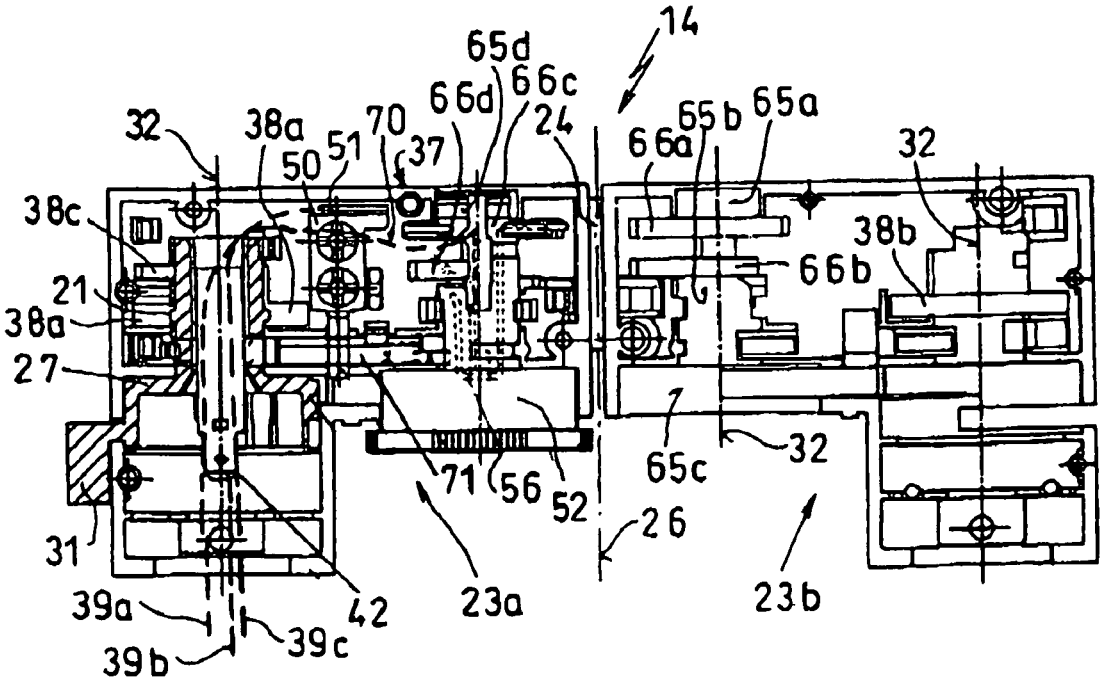
FIG. 2 is a partly sectional view of an embodiment of the device according to the invention shown opened up to reveal the interior of two housing halves.
Figure 5:
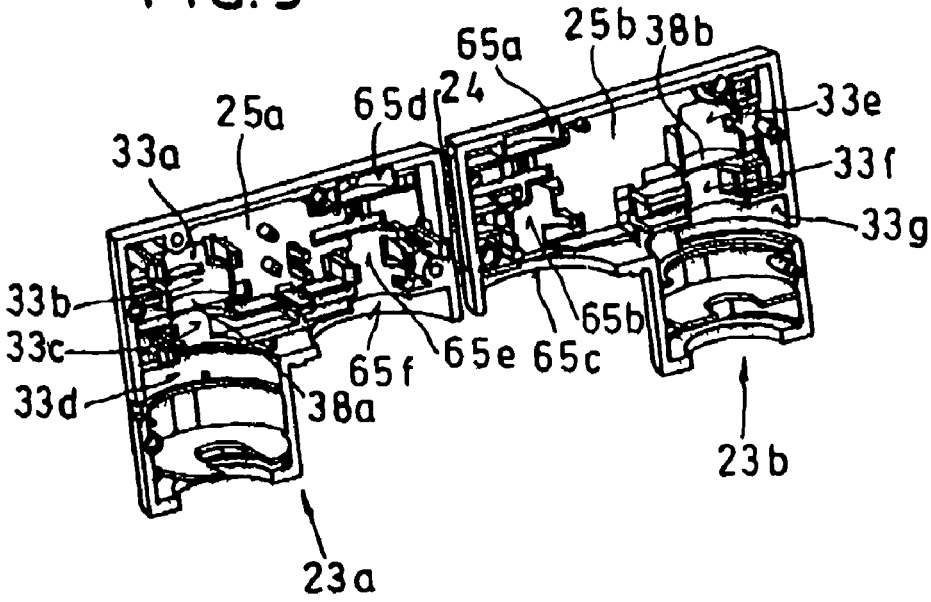
FIG. 5 shows the opened-up housing halves of the device of FIG. 2 in perspective view, the two control shafts and further details being left out for clarity of view.
Figure 6:
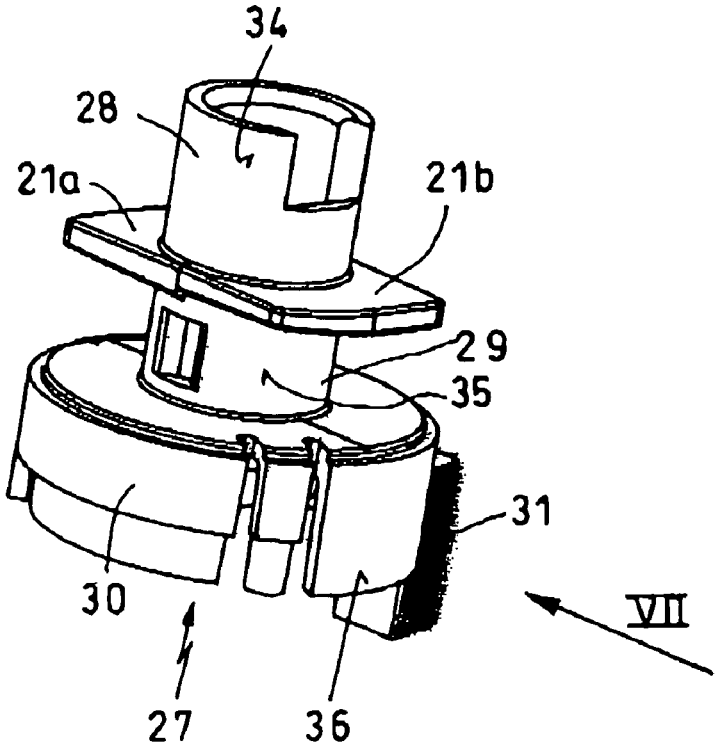
FIG. 6 is a perspective view of the first control shaft from FIG. 2.
Figure 7:
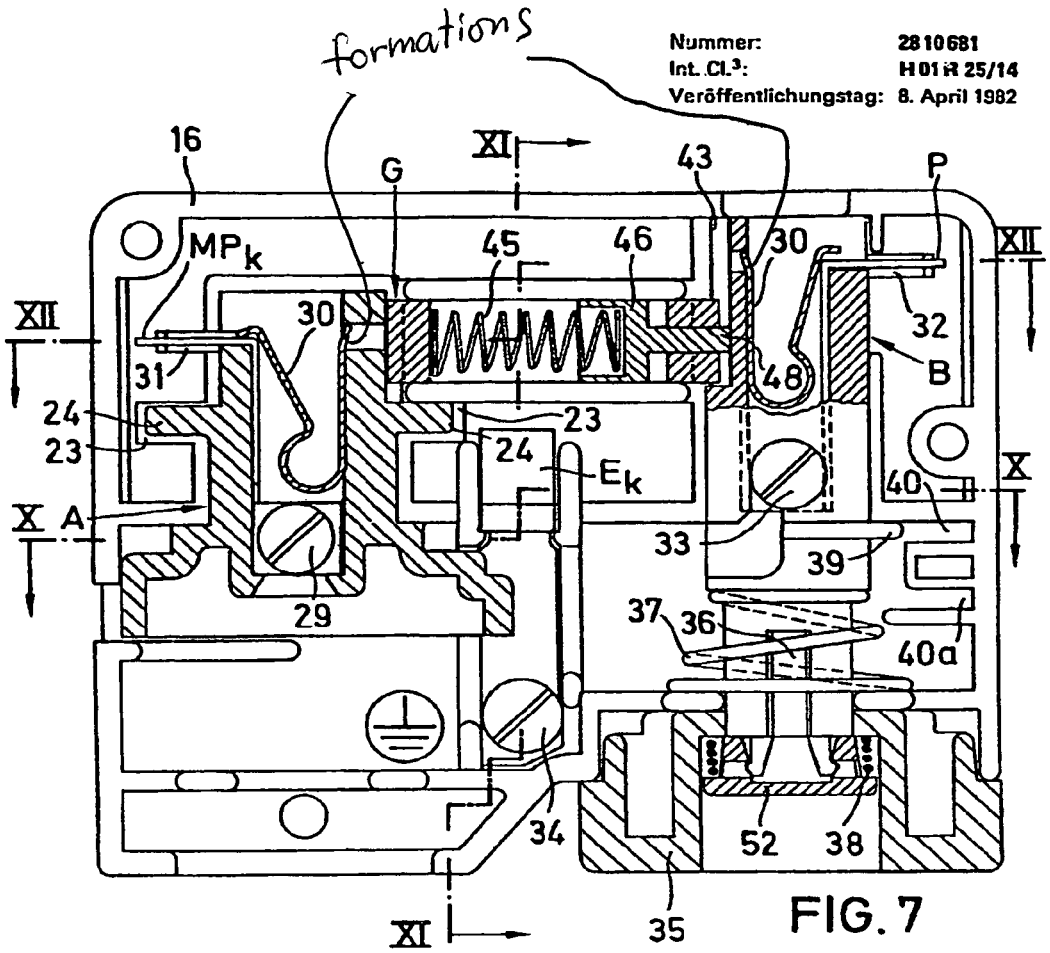
FIG. 7 is a front view of the first control shaft according to FIG. 6.
Figure 12:
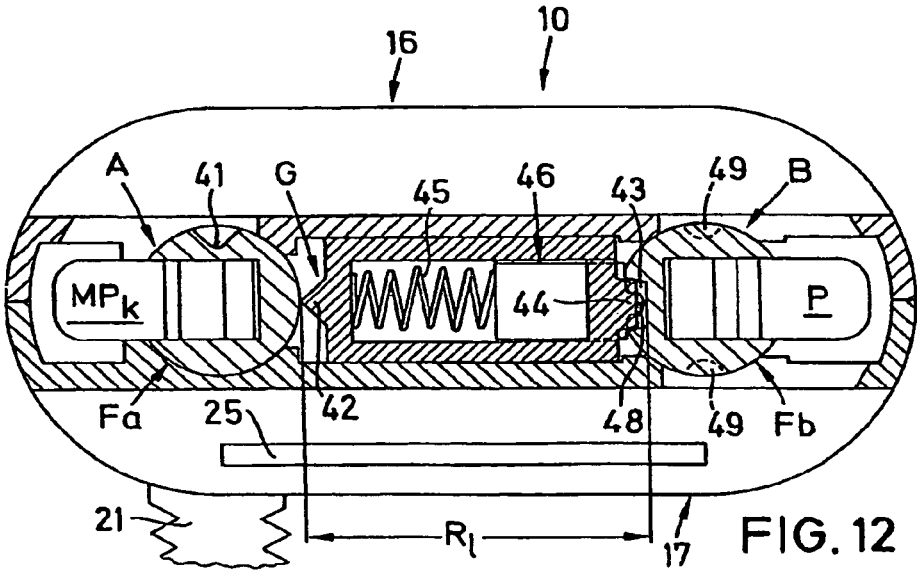
FIG. 12 is the contact according to view arrow XII of FIG. 11.
Figure 11:
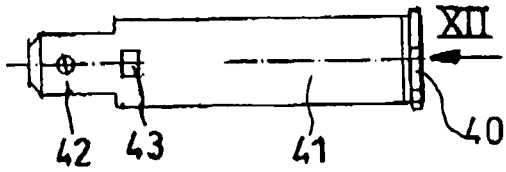
FIG. 11 is the contact according to view arrow XI of FIG. 10.

The device 14 is comprised of two housing halves 23*a* and 23*b* connected together by a central membrane hinge 24. FIG. 5, which shows the two housing halves 23*a* and 23*b* in perspective view with no internal parts, shows how the housing halves 23*a* and 23*b* have back walls 25*a* and 25*b*. The right-hand and left-hand regions as seen in FIG. 5 together form, when closed, that is when the right-hand housing half 23*b* of FIG. 2 is pivoted about an axis 26 of the membrane hinge 24 upward from the plane of the view of FIG. 2 and moved toward then pressed against the left-hand housing half of FIG. 2, a pivot for a first control shaft 27 shown in section in FIG. 2. It is described below with reference to FIGS. 6 to 8.

The first control shaft 27 is a hollow body that has a head region 28, a center region 29, and a foot region 30. The first control shaft 27 is formed as one piece and is of generally circular section with an outside diameter that is relatively small in the head and center regions 28 and 29 and substantially larger as it transitions from the center region 29 to the foot region 30. The head region 28 and center region 29 are separated by the two retaining tongues 21*a* and 21*b*. The foot region 30 carries an actuating arm 31 that allows the user to pivot the first control shaft 27 about its central axis pivot axis 32. FIG. 5 shows a plurality of walls 33*a*, 33*b*, 33*c*, 33*d*, 33*e*, 33*f*, and 33*g* that in the closed condition of the two housing halves 23*a* and 23*b* form a journal for the first control shaft 27. A surface 34 of the head region 28 fits with the walls 33*a*, 33*b*, and 33*e* and a surface 35 of the center region 29 with the walls 33*c* and 33*f*. A surface 36 of the foot region 30 of the first control shaft 27 coacts when the first control shaft 27 is installed with the walls 33*d* and 33*g*.

When installed, the first control shaft 27 can be pivoted by its actuating arm 31 about its pivot axis 32 through an angular range of about 90°. In a nonuse position of the first control shaft 27, the retaining tongues 21*a* and 21*b* are retracted into a housing 37 (FIG. 3) of the device 14. Pivoting the first control shaft 27 through about 90° until it engages a stop pushes the retaining tongues 21*a* and 21*b* outward out of the housing 37 through slots 38*a* and 38*b* in the housing back walls 25*a* and 25*b* and into the retaining grooves 11*a* and 11*b* of the power track 10. In this manner the adapter 14 is mechanically locked to the power track 10.

Figure 9:
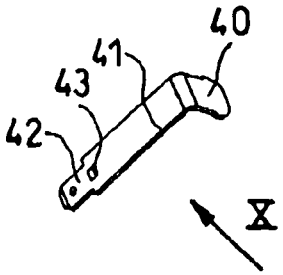
FIG. 9 is a detail view of the contact of FIG. 8 in perspective view.
Figure 10:
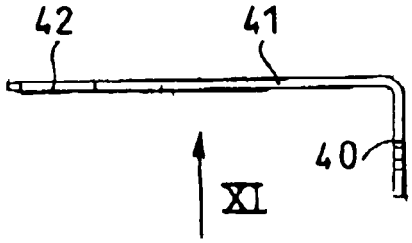
FIG. 10 is the contact according to view arrow X of FIG. 9.

In order to connect lamps not shown in the drawing via schematically illustrated wires 39*a*, 39*b*, and 39*c* with the respective conductors 13*a*, 13*b*, 13*c*, and 13*d*, there are contacts. First the neutral contact 40 on the first control shaft 27 is described:

According to FIG. 9 a contact strip 41 is generally formed as an L-shaped part and can be stamped out of sheet copper. The neutral contact 40 is bent at a right angle and projects when mounted on the first control shaft 27 radially outward generally like the second retaining tongue 21*b* but axially offset therefrom. The second free end of the contact strip 41 is formed as a terminal tab 42. A stamped- and bent-out barb 43 shown in the drawing serves for securing the contact strip 41 on the first control shaft 27.

Figure 8:
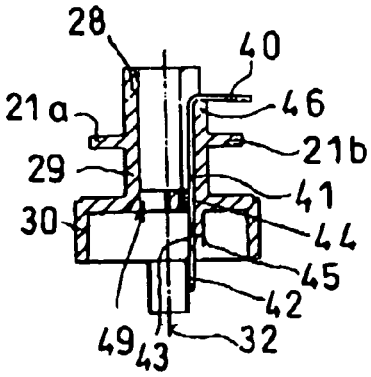
FIG. 8 is a partial sectional view according to section line VIII—VIII of FIG. 7 of the first control shaft with a contact.
Figure 13:
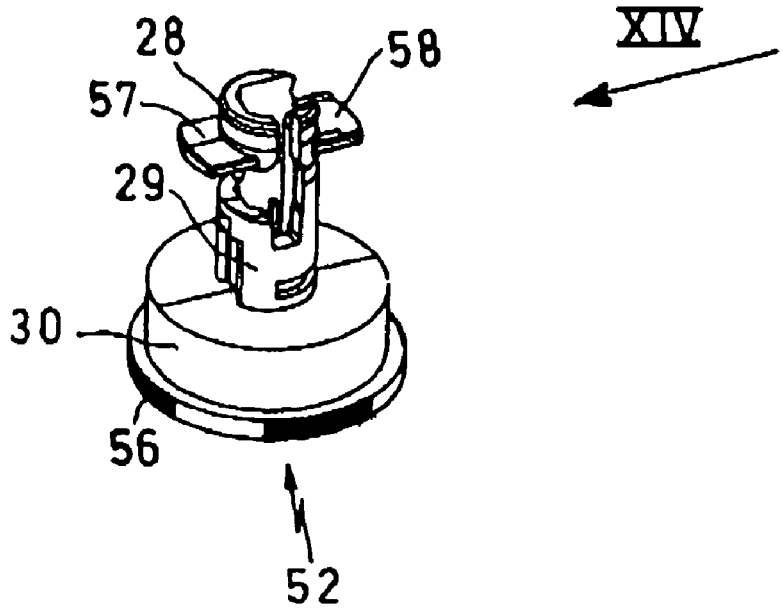
FIG. 13 is a perspective view of the second control shaft of FIG. 2.
Figure 14:
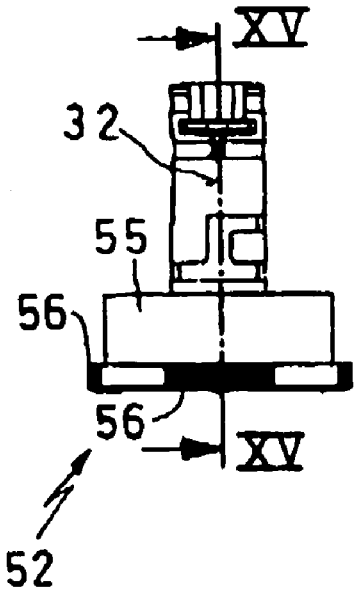
FIG. 14 is the second control shaft according to view arrow XIV of FIG. 13.

According to FIG. 8 the contact strip 41 passes with its terminal tab 42 from above through a hole 44 in the plastic injection-molded first control shaft 27. As soon as the barb 43 engages past an edge face 45 of the first control shaft 27, the contact strip 41 is axially locked in place so that the mounted position of the contact strip 41 on the first control shaft 27 as shown in FIG. 8 is permanent. The neutral contact 40 in the mounted position of FIG. 8 lies against a side wall 46 of the first control shaft 27 and is protected by it. In addition the neutral contact 40 is laterally held between further portions 47*a* and 47*b* of the first control shaft 27.

As a result of how it is held by passing through the hole 44 and by being gripped by the side walls 46, 47*a*, and 47*b*, the neutral contact 40 moves with the first control shaft 27. Pivoting of the first control shaft 27 leads inherently to angular movement of the neutral contact 40 so that, when the first control shaft 27 is pivoted as described above with the retaining tongues 21*a* and 21*b*, the neutral contact 40 projects out of a housing slot 38*c* and engages into the neutral contact groove 12*d* to contact the neutral conductor 13*d*.

It is of particular interest that the terminal tab 42 be formed by an axial end portion of the contact strip 41 and extend generally along the pivot axis 32 of the first control shaft 27. The terminal tab 42 fits into a flat female terminal 48 as shown by way of example in FIGS. 20 and 21. In particular, the terminal tab 42 is constructed such that it can fit with a flat female terminal 48 according to DIN 46247 or DIN 46249.

The wire 39*b*, which is connected with the terminal tab 42 of the first control shaft 27, is only subjected to modest bending stress. The end of the wire executes a maximum angular movement of 90° on pivoting of the first control shaft, so this twisting can be spread over a relatively long axial portion of the wire 39*b* and has only a very small pivot radius. The pivot radius corresponds roughly to the spacing of the terminal tab 42 from the pivot axis 32.

The first control shaft 27 is made, like the housing halves 23*a* and 23*b* and the remaining parts of the device except for the necessarily electrically conductive and thus metallic contacts, of a dielectric, in particular plastic.

The first control shaft 27 forms a throughgoing passage 49 (FIG. 8) through which pass the two further wires 39*a* and 39*c*.

The wire 39*a* can, as shown in FIG. 2, be connected with a neutral contact 50 which also has a terminal tab 51 for connection with an unillustrated female terminal at the end of the wire 39*a*. The third wire 39*c* serves for connection with a terminal tab 42 of a contact strip 41 of a second control shaft 52.

It should be noted that the same or similar elements or parts are assigned for clarity's sake with the same reference numerals, some times with the addition of lower-case letters.

The second control shaft 52 is described below with reference to FIGS. 13 through 16: The second control shaft 52 also has a head region 28, a center region 29, and a foot region 30. The head region 28 and center region 29 have approximately the same outside diameter. The outside diameter of the foot region 30 is however substantially larger.

The second control shaft 52 forms a compartment 53 that holds the contact strip 41. The second control shaft 52 has unlike the first control shaft 27 no throughgoing passage. Instead of this, a floor 54 of the foot region 30 closes the compartment 53. A side outer face 55 of the foot region 30 is formed with actuating ribs 56 forming external teeth that facilitate manual pivoting by a user. The head region 28 and the center region 29 are separated from one another by a retaining tongue 57 and a current-conducting contact 58. The current-conducting contact 58 is part of the contact strip 41 that is shown in detail in FIGS. 16 through 19. The contact strip 41 has adjacent the current-conducting contact 58 a portion 59 bent off at a right angle, an oppositely bent bight portion 60, a mounting portion 61, and the terminal tab 42. The contact strip 41 is preferably one stamped piece, for example of sheet copper, and is given the shape shown in FIG. 16.

Figure 15:
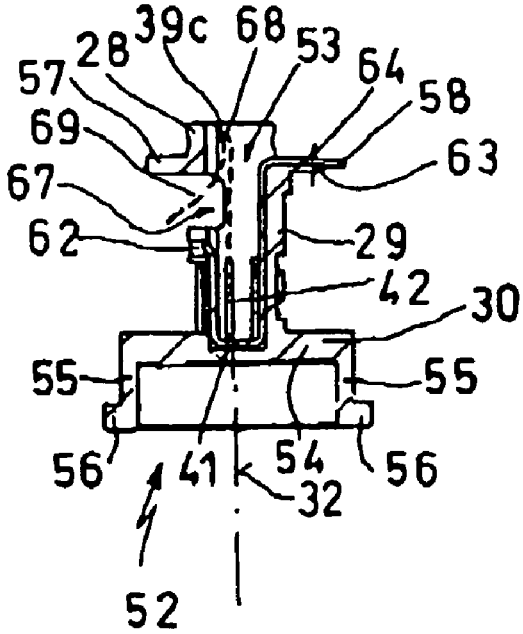
FIG. 15 is a section through the control shaft with a second contact taken along line XV—XV of FIG. 14.
Figure 17:
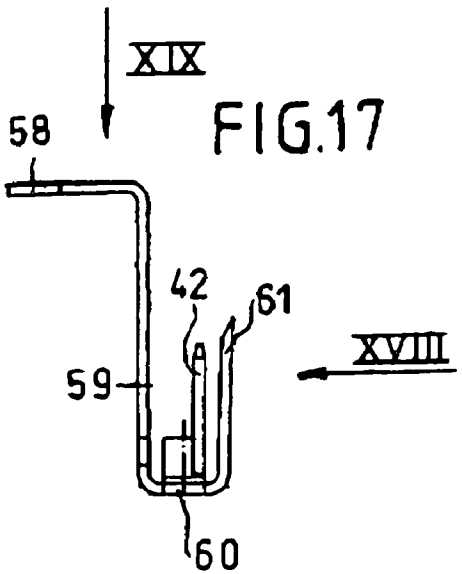
FIG. 17 is a side view of the contact according to view arrow XVII of FIG. 18.
Figure 19:
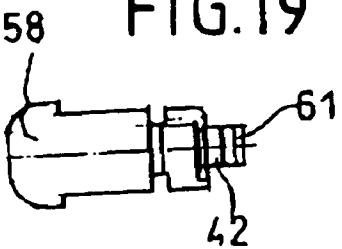
FIG. 19 is the contact according to view arrow XIX of FIG. 17.
Figure 18:
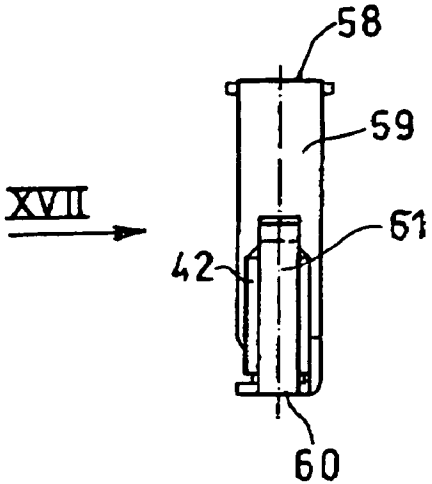
FIG. 18 is the contact according to view arrow XVIII of FIG. 17.
Figure 16:
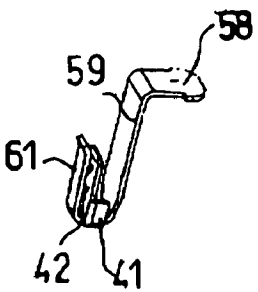
FIG. 16 is a perspective view of the contact of FIG. 15.

The contact strip 41 shown in FIGS. 16 through 19 can be fitted from above as shown in FIG. 15 into the compartment 53, so that its bight portion 60 comes to rest on the floor 54 of the compartment 53. The end position and thus the permanent position of the contact strip 41 is reached when the mounting portion 61 engages with its free end in a recess 62 (FIG. 15) of the second control shaft 52 and in this manner axially locks the contact 51 in the second control shaft 52. When the contact strip 41 is permanently mounted, the current-conducting contact 58 engages with its lower face on a complementary support wall portion 64 of the second control shaft 52.

Here also the hot contact 58 moves synchronously with the second control shaft 52 so that when the second control shaft 52 rotates the hot contact 58 also pivots.

The two housing halves 23*a* and 23*b* as shown in FIGS. 2 and 5 also have walls 65*a*, 65*b*, 65*c*, 65*d*, 65*e*, and 65*f* that coact with respective surfaces of the second control shaft 52. Thus the walls 65*a* and 65*d* form a journal for the surfaces of the head region 28, the walls 65*b* and 65*e* form a journal for the center region 29, and the walls 65*c* and 65*f* form a journal or pivot for the surface of the foot region 30.

In a nonuse position of the second shaft 52 the retaining tab 57 and the hot contact 58 are retracted into the housing 37, but pivoting of the second control shaft 52 into one of its three use positions extends the retaining tab 57 and the hot contact 58 through corresponding slits 66*a*, 66*b*, 66*c*, or 66*d* out of the housing 37.

The second control shaft 52 is mounted so as to be limitedly axially displaceable and also rotatable through an angle of 180°. Hence all three conductor strips 13*a*, 13*b*, and 13*c* can be reached.

Figure 3:
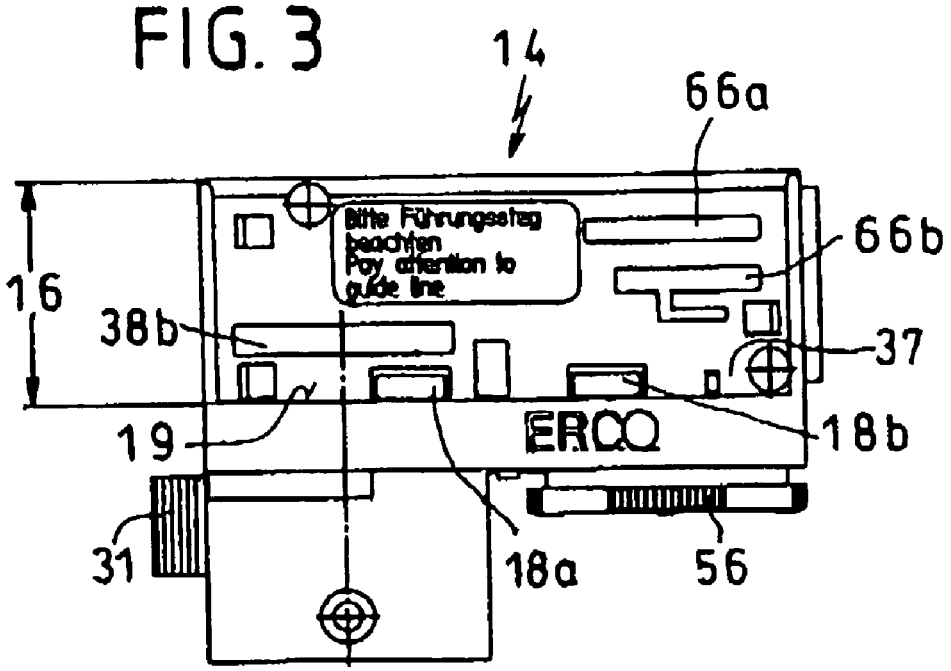
FIG. 3 is a front view of the assembled housing of FIG. 2 without the two control shafts, the right-hand housing half of FIG. 2 being closed over the left-hand housing half of FIG. 2.
Figure 4:
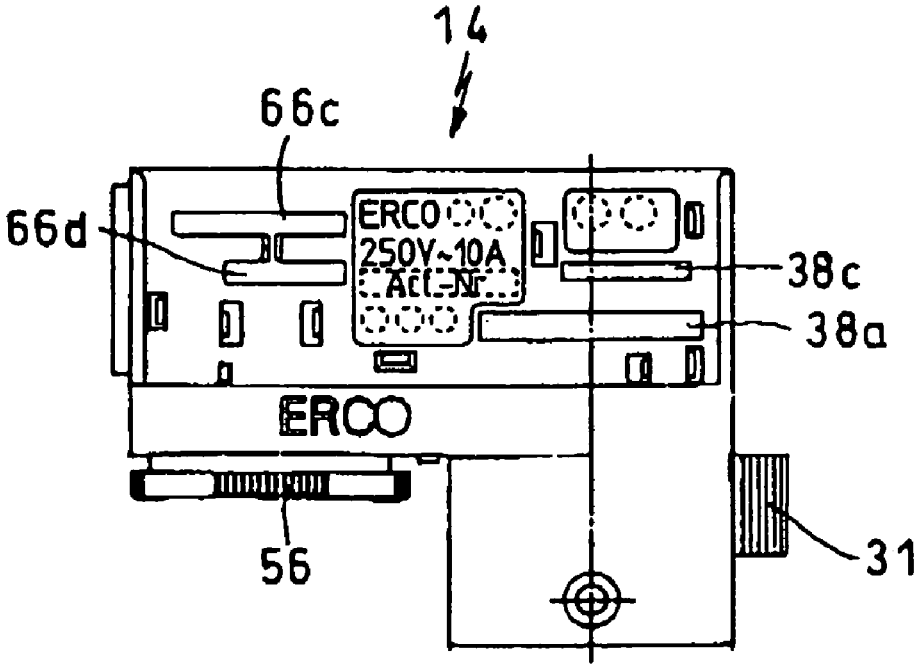
FIG. 4 is a back view of the device.

When the adapter 14 is installed, the actuation ribs 56 are of course freely accessible as shown for example in FIGS. 3 and 4.

It is significant that the terminal tab 42 of the contact strip 41 on the second control shaft 52 is immediately adjacent the pivot axis 32 of the second control shaft 52 and extends along it.

Figure 20:
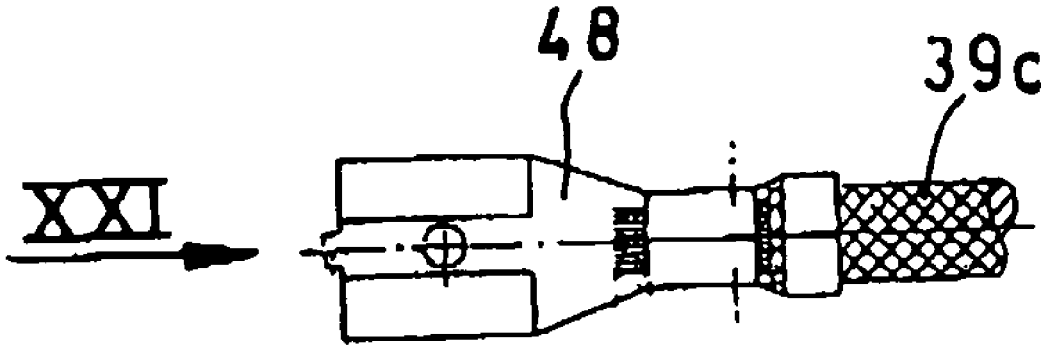
FIG. 20 is a partial view of an end of a wire carrying a flat female contact strip.
Figure 21:
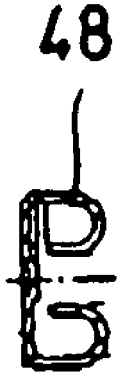
FIG. 21 is a schematic end view of the flat female contact strip according to view arrow XXI of FIG. 20.

In order to connect the third wire 39*c*, which has a flat female terminal 48 as shown in FIG. 20, with the tab 42, the flat female terminal 48 is inserted as shown in FIG. 15 from above into the compartment 53 until it fits with the tab 42. in this manner even with a very simple assembly a stable and long-term contact is achieved without the pivoting of the second control shaft 52 posing any significant bending stress to the wire 39*c*. The wire 39*c* whose path is shown by dashed lines in FIGS. 2 and 15 extends out of the second control shaft through another aperture 67.

Preferably the third wire 39*c* has a first bend 68 and a second bend 69. In this manner 1800 pivoting of the second control shaft 52 is converted into an axial displacement of a section 70 of the wire 39*c* in the housing 37. This axial displacement of the loose section 70 (FIG. 2) does not however pose any damaging stress to the wire 39*c*.

Both the central section between the tabs 40 and 42 of the contact strip 41 of the first control shaft 27 and the portion 59 of the contact strip 51 of the second control shaft 52 are here formed as springs. Stressing of the springs on the respective shafts 27 and 52 produces a leaf-spring effect at the free end of the contact 40 or 58.

If one of the control shafts 27 or 52 is pivoted from its nonuse position into its use position so that the respective contact 40 or 58 can contact the respective conductor, there is only limited radial inward movement of the contact 40 or 58, stressing the spring leg (e.g. 59). Thus in the mounted position of the power-track adapter 14 there is a solid radially outwardly directed prestressing of the contacts 40 and 58 that ensures a permanent and solid electrical contact.

It should be noted that between the first control shaft 27 and the second control shaft 52 there is a coupling member shown schematically in FIG. 2 at 71 that serves to move the second control shaft 52 from the nonuse into the use position only after the first control shaft 27 has been moved into its use position. Similarly the first shaft 27 can only be moved from its use position into its nonuse position when the second control shaft 52 has been moved into its nonuse position.

Further description of the object of the invention is found in jointly filed U.S. patent application Ser. No. 10/802,695 of applicant whose content is herewith incorporated by reference.

What is claimed is:

1. In combination with a power track having a slot in which are exposed electrical conductors, an adapter comprising:

a housing having an insert part fittable into the slot;

a shaft extending into the insert part and pivotal about a shaft axis in the housing between a use position and a nonuse position;

a one-piece conductive contact element rotationally fixed to the shaft, having a contact projecting radially from the shaft and engageable with one of the power-track conductors when the insert part is fitted to the slot and the shaft is in the use position, and having a one-piece plug-type terminal extending generally parallel to the axis;

means including formations unitarily formed with the contact element and the shaft for axially and rotationally fixing the contact element on the shaft; and a hookup wire provided with another plug-type terminal mated with the terminal of the contact element.

2. The power-track adapter defined in claim 1, further comprising a second shaft separate from the first-mentioned shaft, extending into the insert part, and pivotal about a second shaft axis in the housing between a use Position and a nonuse position;

a second conductive contact element separate from the first-mentioned contact element, rotationally fixed to the second shaft, having a contact projecting radially from the second shaft, and engageable with another of the power-track conductors when the insert part is fitted to the slot and the second shaft is in the use position, and having a one-piece plug-type terminal extending generally parallel to the axis of the second shaft; and a second hookup wire separate from the first-mentioned hookup wire and provided with a plug-type terminal mated with the terminal of the second contact element.

3. The power-track adapter defined in claim 1 wherein the plug-type terminal of the hookup wire is displaceable axially in the housing for connection with and disconnection from the terminal of the contact element.

4. The power-track adapter defined in claim 1 wherein the contact is unitarily formed with the contact element.

5. The power-track adapter defined in claim 4 wherein the contact element is formed as a spring urging the contact radially outward.

6. The power-track adapter defined in claim 1 wherein the control shaft is at least partially hollow.

7. The power-track adapter defined in claim 6 wherein the control shaft is formed with a throughgoing passage, the adapter further comprising another feed wire extending through the passage.

8. In combination with a power track having a slot in which are exposed electrical conductors, an adapter comprising:

a housing having an insert part fittable into the slot;

a shaft extending into the insert part and pivotal about a shaft axis in the housing between a use position and a nonuse position;

a conductive contact element rotationally and axially fixed to the shaft, having a contact projecting radially from the shaft and engageable with one of the power-track conductors when the insert part is fitted to the slot and the shaft is in the use position, and having a one-piece plug-type terminal extending generally parallel to the axis; and a hookup wire provided with another plug-type terminal mated with the terminal of the contact element and displaceable generally parallel to the axis between a position interfitting with and electrically coupled to the terminal of the contact element and a position disconnected therefrom.

9. In combination with a power track having a slot in which are exposed electrical conductors, an adapter comprising:

a housing having an insert part fittable into the slot;

a one-piece shaft extending into the insert part and pivotal about a shaft axis in the housing between a use position and a nonuse position;

a conductive contact element rotationally fixed to the shaft, having a contact projecting radially from the shaft and engageable with one of the power-track conductors when the insert part is fitted to the slot and the shaft is in the use position, and having a one-piece tongue-shaped plug-type terminal extending generally parallel to the axis; and a hookup wire provided with a plug-type terminal mated with the terminal of the contact element.

* * * * *